US005791751A

United States Patent [19]

Meyer et al.

[11] Patent Number: 5,791,751

[45] Date of Patent: Aug. 11, 1998

[54] OFFICE FURNITURE CONSTRUCTION

[75] Inventors: Peter Meyer, Goschen; Mitchell P. Clark, Elkhart, both of Ind.

[73] Assignee: Steelcase Inc., Grand Rapids, Mich.

[21] Appl. No.: 655,975

[22] Filed: May 31, 1996

[51] Int. Cl.[6] ..... A47B 27/00

[52] U.S. Cl. ..... 312/196; 312/317.3

[58] Field of Search ..... 312/196, 323, 312/322, 331, 317.3

[56] References Cited

U.S. PATENT DOCUMENTS

| | | |
|---|---|---|
| 287,475 | 10/1883 | Ross . |
| 349,875 | 9/1886 | Crocker . |
| 637,325 | 11/1899 | Crowell . |
| 1,084,211 | 1/1914 | Hunter . |
| 2,037,919 | 4/1936 | Poe . |
| 2,098,157 | 11/1937 | Nurenberg . |
| 2,227,786 | 1/1941 | La Fee . |
| 2,293,496 | 8/1942 | Egger . |
| 2,604,369 | 7/1952 | Phillips et al. . |
| 2,605,153 | 7/1952 | Lietz . |
| 2,854,309 | 9/1958 | Levine . |
| 2,988,413 | 6/1961 | Bergen . |
| 3,179,071 | 4/1965 | Johnston . |
| 3,823,993 | 7/1974 | Kakishima et al. . |
| 3,862,785 | 1/1975 | Scheerhorn et al. . |
| 4,258,963 | 3/1981 | Fusselman et al. . |
| 4,830,614 | 5/1989 | Schricker et al. . |
| 5,454,636 | 10/1995 | Taub . |

*Primary Examiner*—Peter R. Brown
*Assistant Examiner*—Gerald D. Anderson
*Attorney, Agent, or Firm*—Price, Heneveld, Cooper, DeWitt & Litton

[57] ABSTRACT

An office furniture construction includes a desk having a primary work surface and a service unit mounted over the work surface including an overhead bookshelf and side located supports for supporting the overhead bookshelf. A work table is pivoted to the worksurface for horizontal movement between an inwardly pivoted position for use by the primary user, and an outwardly pivoted position for providing an open arrangement conducive for conferencing by a group of workers. The office system further includes a bifolding security door movably attached to the service unit for articulated movement between a storage position located generally under the overhead bookshelf, and a closed secured position covering a front edge of the work surface that prevents access to the primary work area. By using the security door, a primary user is able to leave confidential papers spread out on the primary work surface between work sessions, but is able to secure the papers from view by other workers even when the other workers use the table, such as when the primary user is gone.

14 Claims, 6 Drawing Sheets

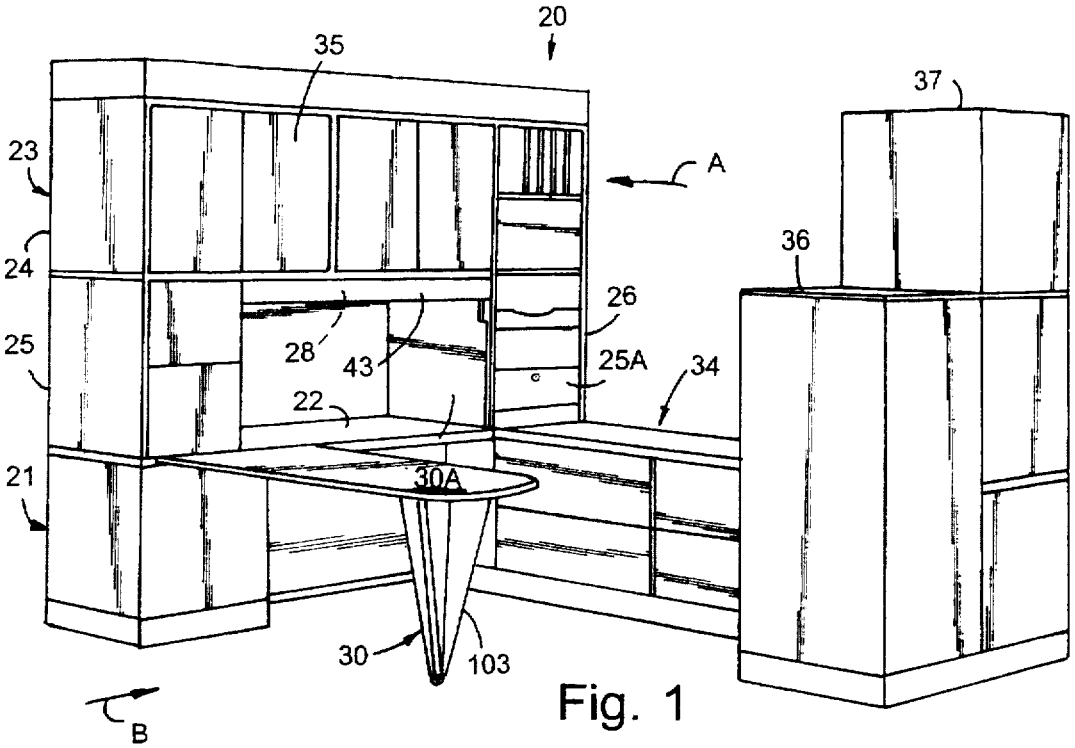
Fig. 1
Fig. 2
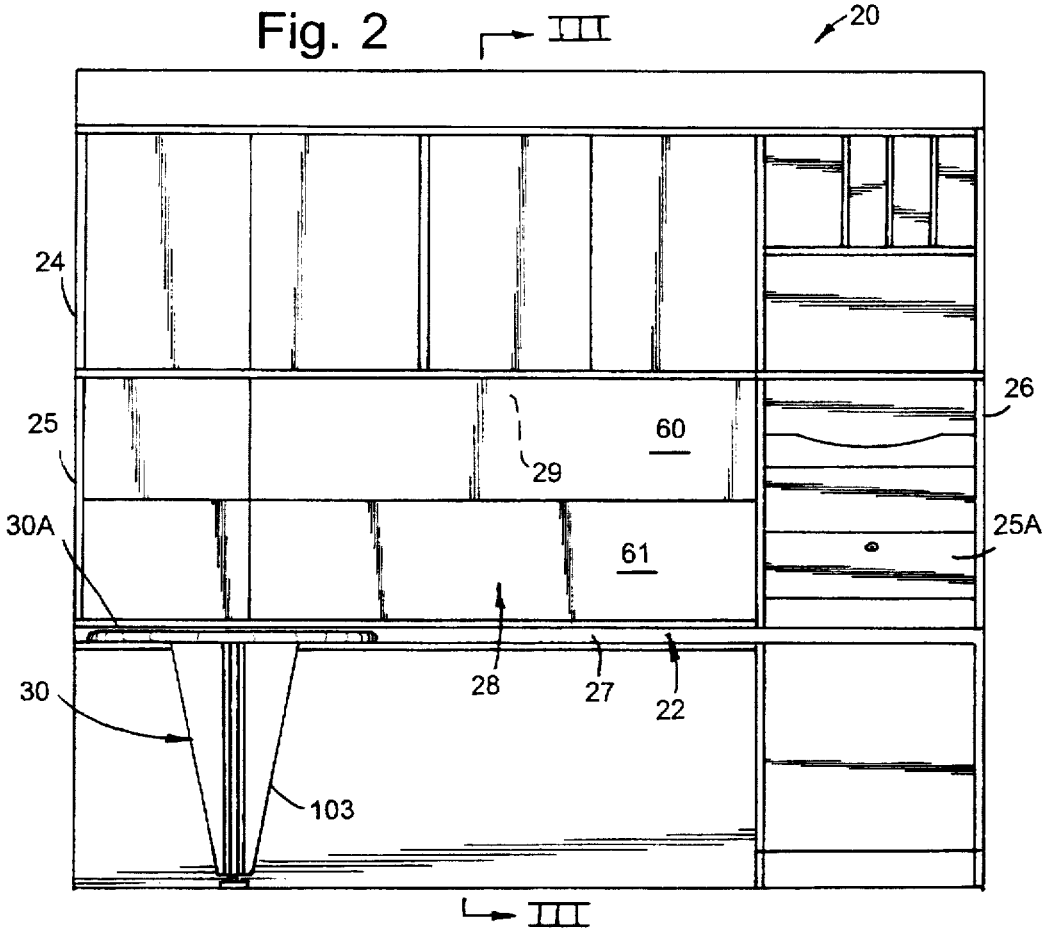

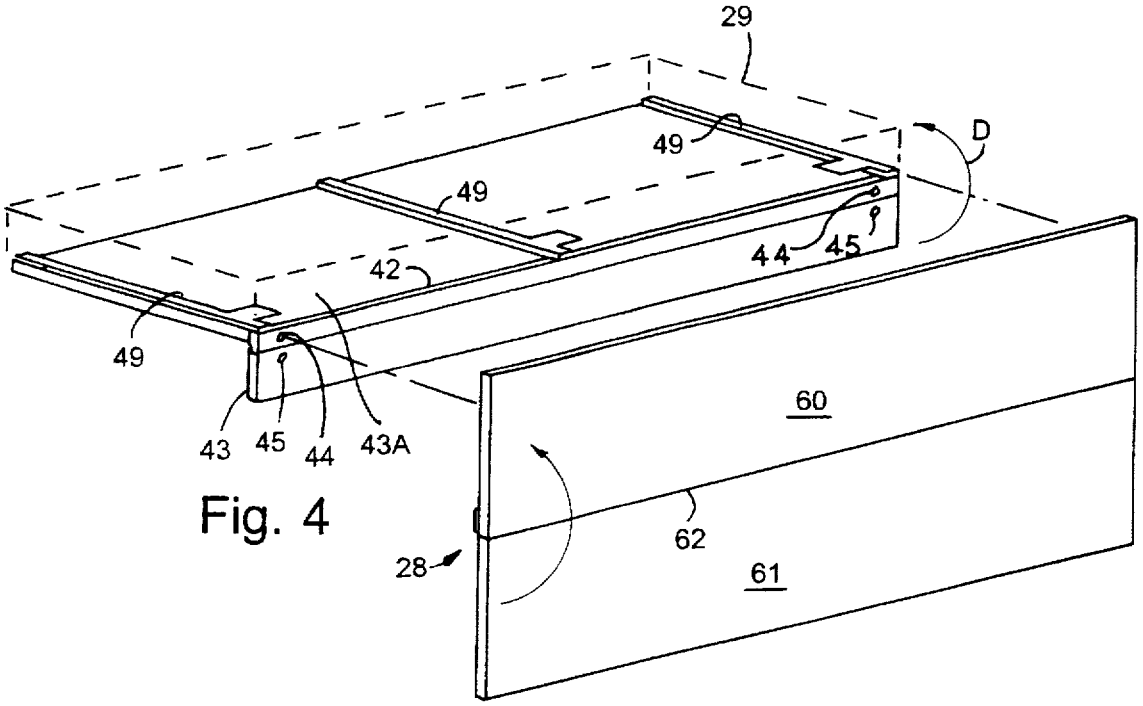
Fig. 4
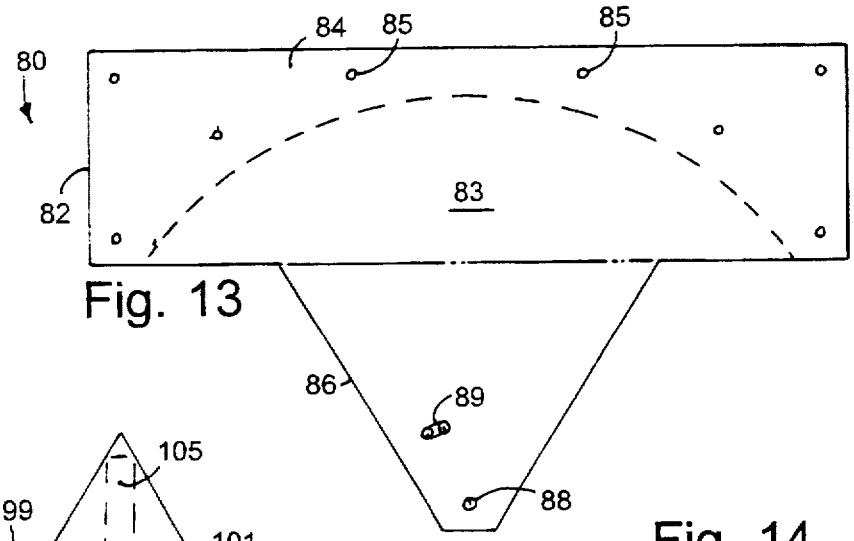
Fig. 13
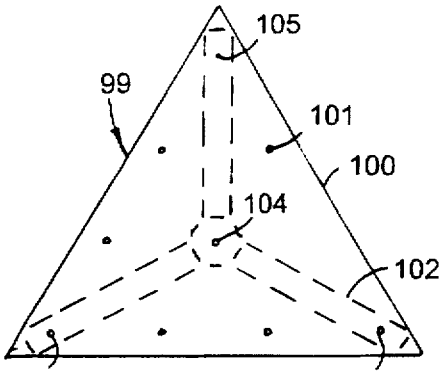
Fig. 15
Fig. 14
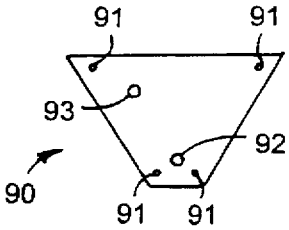

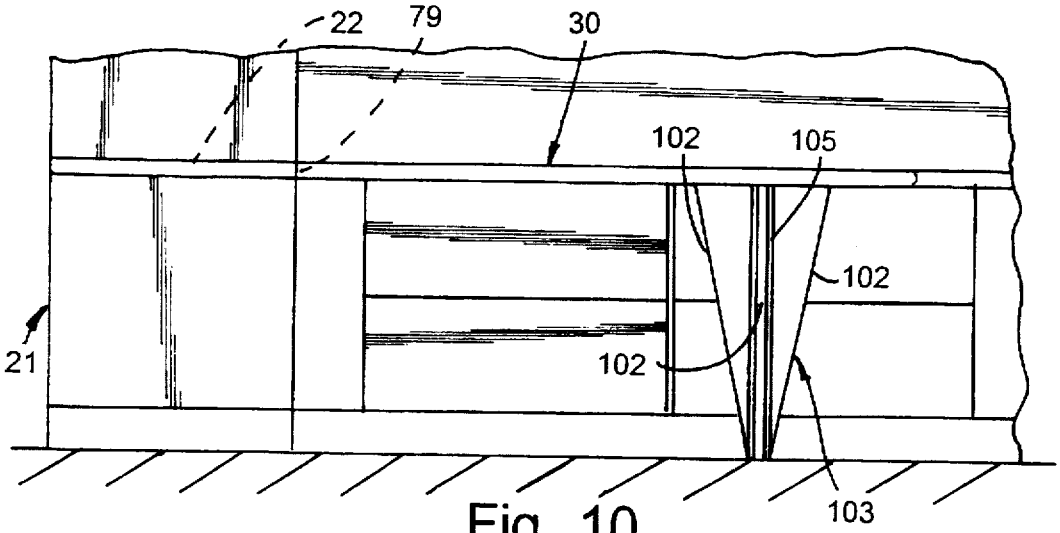
Fig. 10
Fig. 11
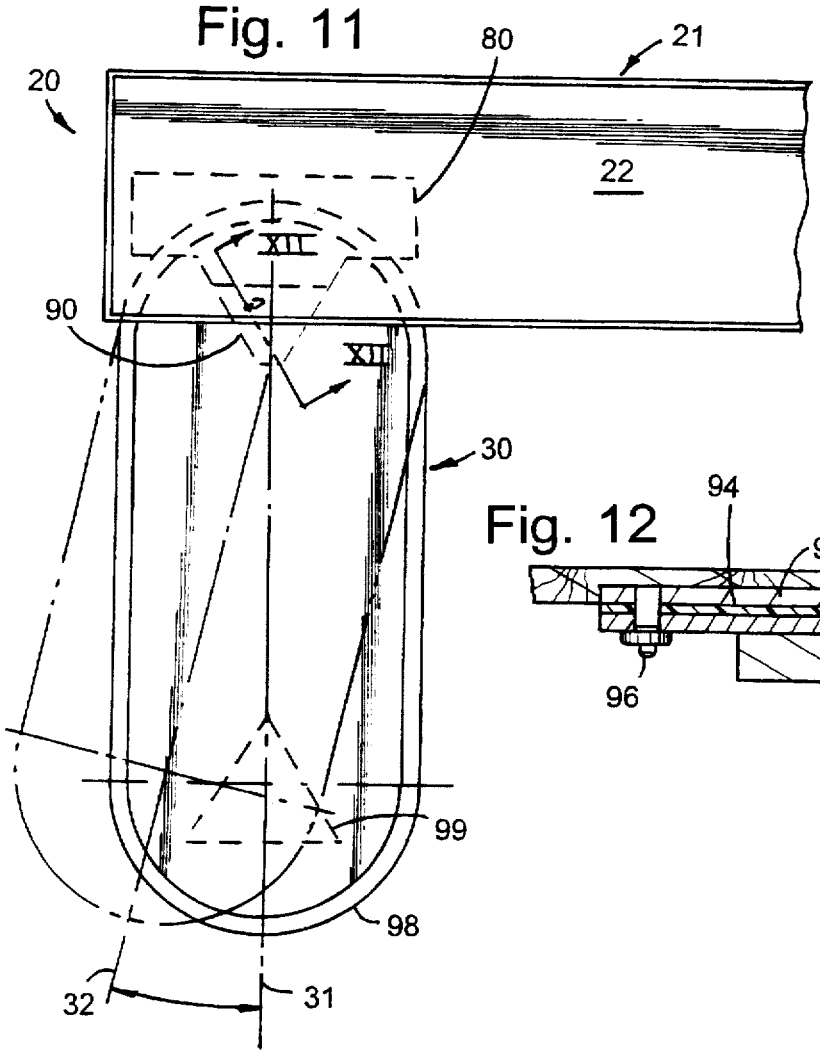
Fig. 12
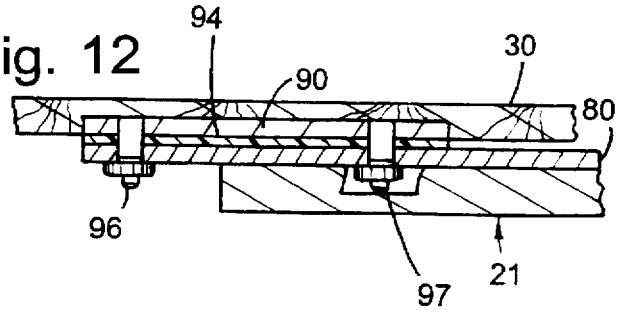

OFFICE FURNITURE CONSTRUCTION

BACKGROUND OF THE INVENTION

The present invention concerns office furniture, and more particularly concerns office furniture constructed for conferencing, but also constructed for securing a primary work surface, so that the conferencing table can be used by coworkers without the primary user having to clear papers from the primary work surface to maintain confidentiality of the papers.

Modern office furniture often incorporates multiple work surfaces, some of which are intended for use only by a primary user and other of which are intended for conferencing or group meetings. Some office furniture does provide an adjustable repositionable table, such as Crowell U.S. Pat. No. 637,325 (to Crowell), to facilitate conferencing. But as a practical matter, the primary user is often likely to discourage coworkers or subordinates from using his or her office furniture for conferencing, since if used by others, the primary user must pick up and store papers in order to maintain the confidentiality of the papers. But the act of picking up paper may cause some papers to become lost or misarranged. Further, it can be very disruptive and inefficient for the primary user to have to repeatedly pick up and then later again spread out various papers between work sessions.

Aside from the conflict of encouraging conferencing by coworkers, but also maintaining the security of the primary user's main work area, the office furniture must be adapted to provide a visually attractive setting. Further, the office furniture must maintain the functionality of the furniture, while also maintaining a low cost and efficient manufacture, and while still providing simplicity of operation to the primary user.

Accordingly, office furniture solving the aforementioned problems is desired.

SUMMARY OF THE INVENTION

In one aspect, the present invention includes an office furniture construction having a work surface defining a primary work area, and a service unit including an overhead bookshelf spaced above the work surface. The service unit includes opposing side supports located on opposite side edges of the primary work surface for supporting the bookshelf above the work surface and for enclosing the work area except above a front edge of the work surface. The service unit further includes a second shelf spaced below the bookshelf that defines a storage cavity with the bookshelf. A bifolding door is movably secured to the service unit for articulated movement between a storage position wherein it is located within the storage cavity, and a security position wherein the bifolding door extends between the second shelf and the front edge of the work surface and also between the side supports to prevent visual or physical access to the work area.

In another aspect, the present invention includes an office furniture construction having a desk unit defining a work surface with a primary work area, and a service unit attached to the desk unit generally enclosing the primary work area except along a front edge of the work surface. A work table is pivotally attached to the desk unit for movement along a limited arc between an inwardly pivoted position facilitating use by a primary user and an outwardly pivoted position facilitating use by a group of workers having a conference. The service unit further includes a multi-panel security door movably attached to the service unit for movement between a hidden storage position within the service unit and an extended closed position wherein the security door prevents access to the work area. Advantageously, the primary user can leave confidential papers spread out in the primary work area between work sessions, yet can permit use of the work table for conferencing by coworkers and/or subordinates without fear of exposing the confidential papers.

These and other features and advantages of the present invention will be further understood and appreciated by those skilled in the art by reference to the following specification, claims, and appended drawings.

DESCRIPTION OF DRAWINGS

FIG. 1 is a perspective view of the furniture unit including a desk unit, a service unit, a work table, and a return terminating in a storage unit, the work table being in an inwardly pivoted position and the multi-panel bifolding security door being in a hidden stored position under the bookshelf of the service unit;

FIG. 2 is an elevational view taken in the direction "A" in FIG. 1;

FIG. 4 is an exploded perspective view of the secondary shelf that forms a bottom of a storage cavity (the storage cavity being shown in dashed lines) under the bookshelf, the secondary door for closing the storage cavity, and the bifolding security door;

FIG. 10 is a fragmentary elevational view taken in direction "B" in FIG. 1;

FIG. 11 is a fragmentary plan view of the work table shown in FIG. 1 in the inwardly pivoted position (shown in solid lines) and in the outwardly pivoted conferencing position (shown in phantom lines);

FIG. 12 is a cross sectional view taken along the line XII—XII in FIG. 11;

FIG. 13 is a plan view of the stationary bracket for attachment to the desk unit in FIG. 11;

FIG. 14 is a plan view of the work table pivot-limiting bracket for attachment to the work table for operably engaging the stationary bracket shown in FIG. 11; and FIG. 15 is a plan view of the table-leg-supporting bracket for attaching the leg of the work table to the work table.

DETAILED DESCRIPTION OF PREFERRED EMBODIMENT

Figure 3:
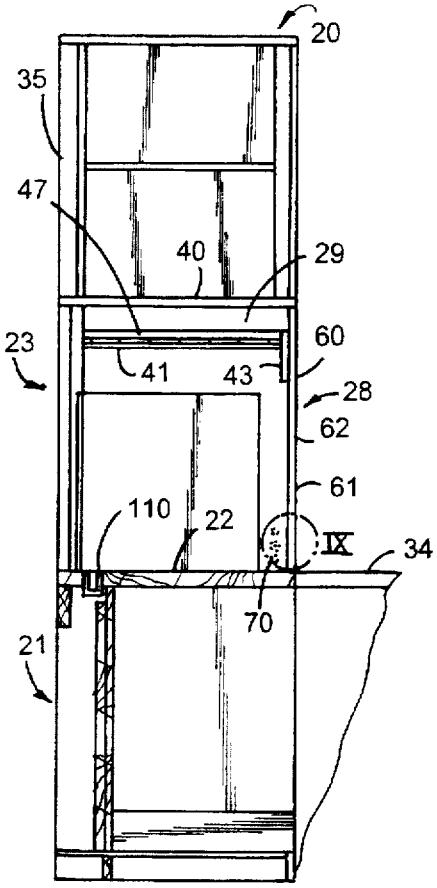
FIG. 3 is a cross sectional view taken along the line III—III in FIG. 2.
Figure 6:
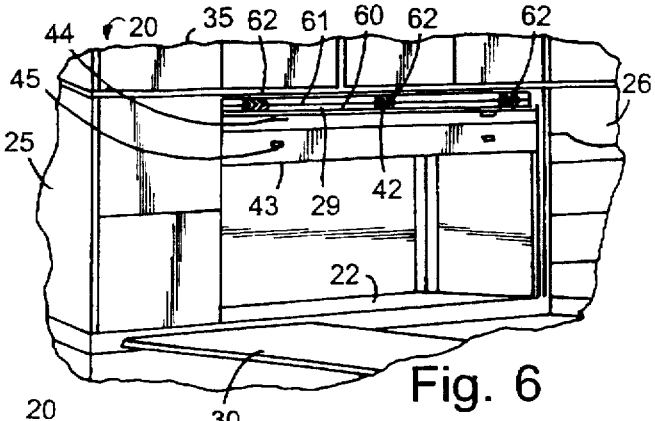
FIG. 6 is a fragmentary perspective view of the work area with the secondary door opened but with the bifolding security door still in the storage position.
Figure 7:
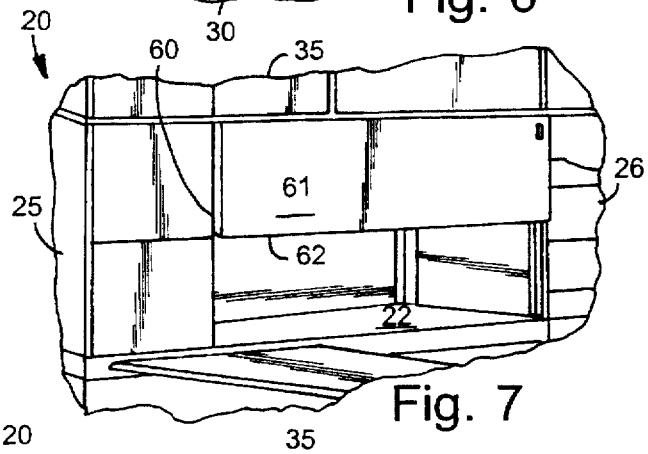
FIG. 7 is a fragmentary perspective view comparable to FIG. 6, but with the bifolding security door in a lowered and partially unfolded position.
Figure 8:
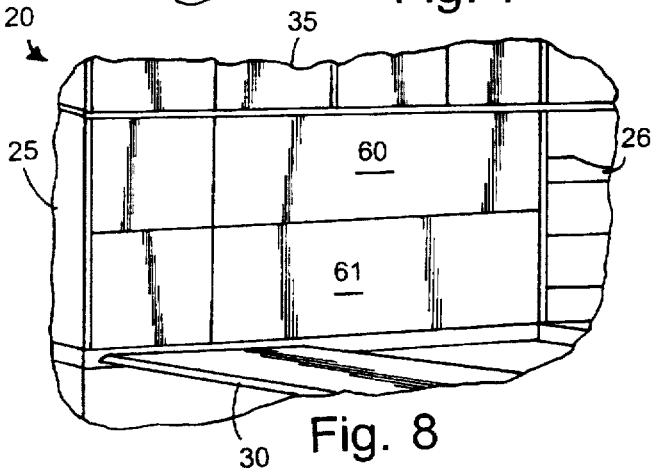
FIG. 8 is a fragmentary perspective view comparable to FIG. 7, but with the bifolding security door in a completely extended, unfolded and locked position for securing the work area.
Figure 9:
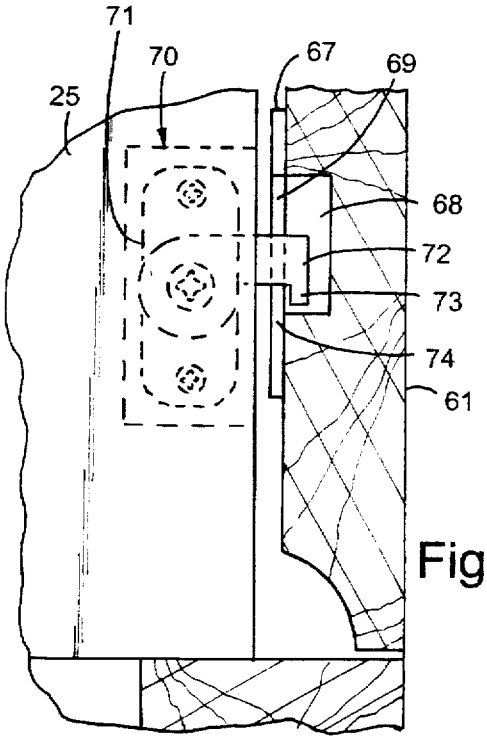
FIG. 9 is an enlarged fragmentary view of the circled area labeled IX in FIG. 3 showing the locking structure.

An office furniture construction 20 (FIG. 1) embodying the present invention includes a desk unit 21 having a worksurface 22, and a service unit 23 having a bookshelf 24 supported above the worksurface 22 by side supports 25 and 26. The service unit 23 generally encloses the work area on the worksurface 22 except above and along the front edge 27 of the worksurface 22. A bifold security door 28 is operably mounted to service unit 23 for movement between a stored position within a storage cavity 29 in the service unit 23, and an extended security position wherein the worksurface 22 is closed off and protected from visual or physical access by the security door 28 (FIGS. 2, 3, and 9). A work table 30 (FIG. 1) is pivoted to the desk unit 21 proximate an end of the worksurface 22. The work table 30 is pivotable between an inwardly-pivoted position 31 (FIG. 11) for use by the primary user of the furniture construction 20, and an outwardly-pivoted position 32 providing extra room around the work table 30, so that the work table 30 is useable as a conferencing table by groups of workers. Advantageously, confidential papers on the worksurface 22 do not need to be picked up and removed from the worksurface 22 since the bifold security door 28 can be pivoted to the security position to prevent unauthorized access to the papers. Thus, the primary user can leave his or her area without physically disrupting an array of confidential papers being worked on, yet the conferencing table can be freely used by workers when the primary user is away from his or her office without fear of lost confidentiality.

Furniture unit 20 (FIG. 1) defines a U shaped office arrangement having a primary work area on the worksurface 22, but also having work areas on the work table 30 and a return 34. File storage is provided in multiple places, including drawers and compartments in desk unit 21 below worksurface 22, in side supports 25 and 26, in bookshelf 24, and under return 34. Doors 35 are provided for covering the bookshelf 24 to provide a flush clean appearance to the furniture unit 20. The illustrated furniture unit 20 further includes a storage module comprising a coat closet 36 and a file storage cabinet 37. Worksurface 22 can include various amenities, such as wireway trough 110 (FIG. 5) along its rear edge 111.

Bookshelf 24 (FIG. 5) includes a bottom shelf 40 for supporting books and papers placed within bookshelf 24. A secondary shelf 41 is spaced below bottom shelf 40 and creates the storage cavity 29 (shown in dashed lines in FIG. 4). Secondary shelf 41 is supported at its sides by inside panels of side supports 25 and 26, and is also reinforced by braces or brackets as required, depending upon the size and weight of security door 28 and depending upon the functional requirements of the system. A cross brace 42 is secured to along the front edge of secondary shelf 41, and a secondary door 43 is pivoted to the bottom of cross brace 42. The secondary door 43 is somewhat wider than the opening 43A to storage cavity 29 and is pivoted about a horizontal axis such that the secondary door 43 aesthetically covers the opening when the secondary door 43 is pivoted to a raised/closed position along arc "D". The horizontal axis of rotation for secondary door 43 is located along an edge and rear surface of secondary door 43 so that the door pivots out of the way below the cross brace 42 when the secondary door 43 is opened. (See FIG. 5.) The cross brace 42 and the secondary door 43 include mating magnets 44 and 45, respectively, for latchingly holding secondary door 43 in the closed position.

A door support mechanism 47 (FIG. 5 and 5A) operably mounts bifolding security door 28 to service unit 23 for articulated movement in and out of storage cavity 29. Mechanism 47 includes a pair of spaced apart linear bearings 48 (FIG. 5A) each having a stationary member 49, roller bearings 50, and a linearly translatable member 51 engaging roller bearings 50 on stationary member 49. The translatable members on each bearing are connected by a cross piece 51A. A pair of elongated brackets 52 (FIG. 5) extend from cross piece 51A and each include a forwardly downwardly angled section 52A and an forwardly upwardly angled section 52B. The free end of elongated bracket 52 extends into a pocket in a cup-shaped bracket 53 inset into the upper panel 60 of bifolding security door 28. The free end of bracket 52 is pivotally engaged by a pivot pin 55. Wide rollers 56 (FIG. 5A) supported by brackets 56A are secured to the upper surface of secondary shelf 41 for movably supporting security door bottom panel 61 as the security door 28 is linearly telescoped into or out of storage cavity 29.

Figure 5:
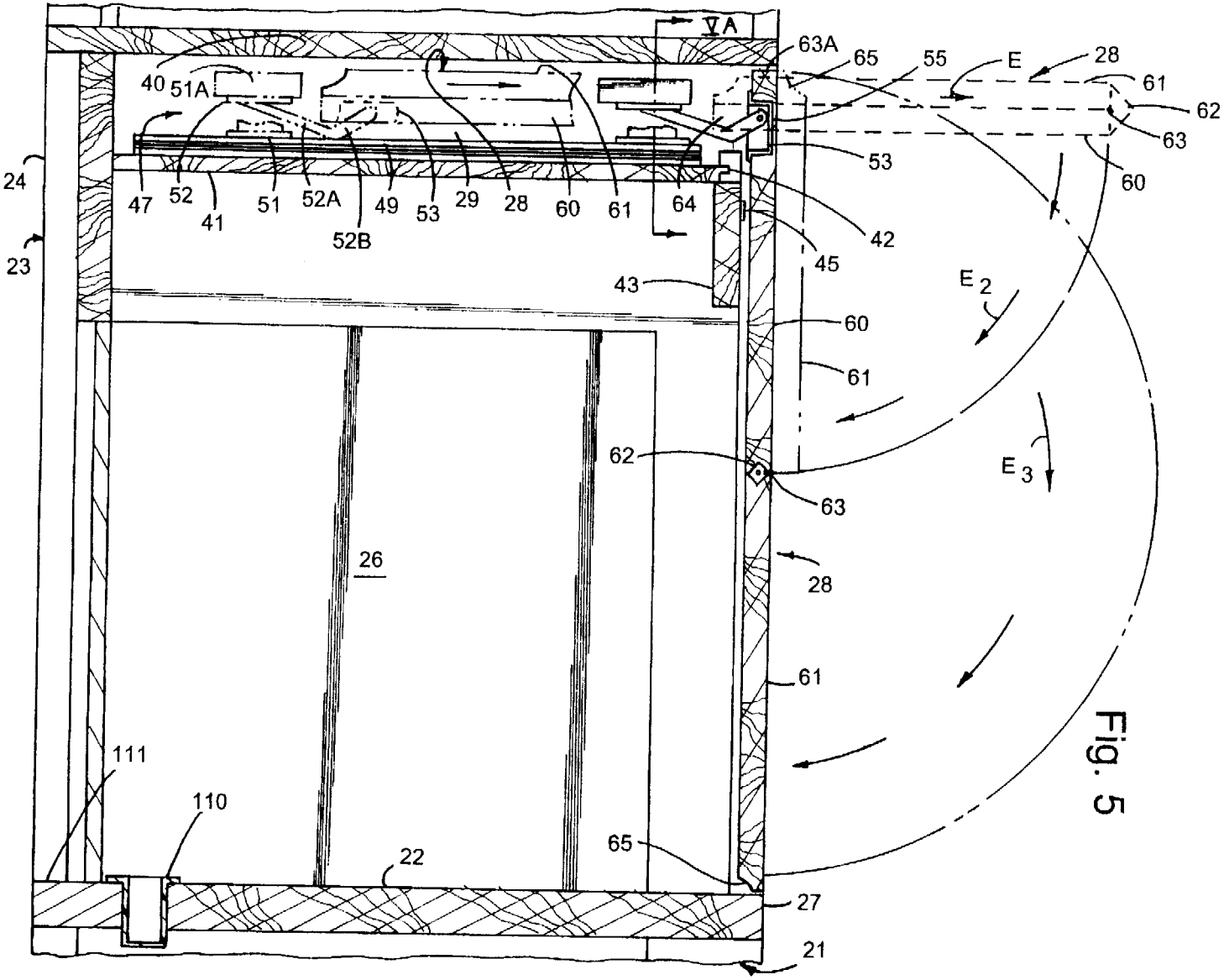
FIG. 5 is an enlarged cross sectional view of the work area above the work surface including the storage cavity for the bifolding security door, the bifolding security door being shown in phantom lines in the stored position, in dashed lines in the extended horizontal position, and in solid lines in the vertically disposed security position.
Figure 5A:
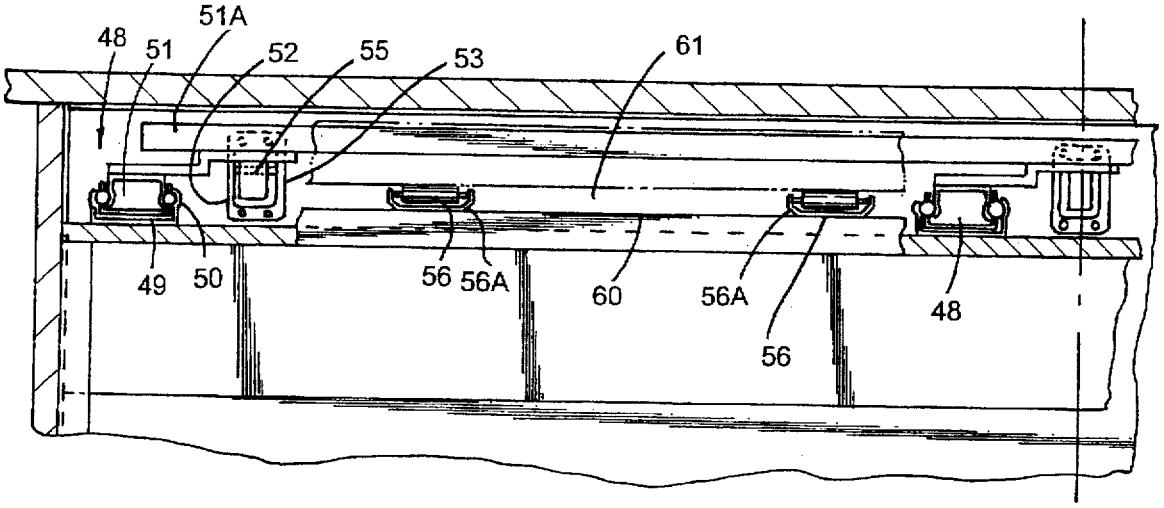
FIG. 5A is a cross sectional view taken along the line VA—VA in FIG. 5.

Bifolding security door 28 includes an upper panel 60 and a lower panel 61 connected by a hinge 62, such as a "Soss" hinge known in the trade. The hinge 62 positions the folding axis 63 of the security door 28 at the front and abutting edges of the upper and lower panels 60 and 61, so that the folding axis 63 allows the lower panel 61 to move between an unfolded security position (shown in solid lines in FIG. 5) wherein the panels 60 and 61 are aligned vertically and positioned tight against each other, and a compact folded position (shown in phantom lines in FIG. 5) wherein the upper and lower panels 60 and 61 lay flat against each other for compact storage. Cup-shaped bracket 53 is located a few centimeters below the upper edge 63A of upper panel 60 so that a portion 64 of upper panel 60 swings upwardly to cover that part of the storage cavity opening that is above pivot pin 55 as the remaining part of upper panel 60 swings downwardly to the vertical security position. Enough clearance is provided above pivot pin 55 so that the total thickness of upper and lower panels 60 and 61, when in the folded position, fit under bottom shelf 40 and between shelves 40 and 41. Also, the lower edge 65 of lower panel 61 is bevelled to provide additional clearance as the folded panels 60 and 61 are pivoted from an extended folded horizontal position to a folded vertical position (FIG. 5). Also, the angled sections 52A and 52B provide clearance for the portion 64 when the folded security door 28 is in the horizontal position (see FIG. 5).

A lock plate 67 (FIG. 9) is provided at the lateral side and lower edge 65 of lower panel 61 on an inside surface thereof, and a recess 68 is provided under an aperture 69 in lock plate 67. A lock 70 is positioned in the side support 25 (or 26) in a position accessible through a lockable drawer 25A (FIG. 1). Lock 70 (FIG. 9) is secured to side support 25 by a screwed flange 71, and includes a tumbler having a locking finger 72 with a hooked end 73 configured to extend through lock plate aperture 69 into interlocked engagement with a marginal edge 74 of lock plate aperture 69. This holds lower panel 61 of security door 28 downwardly and against side supports 25 and 26. Further, since lock finger 72 holds the lower panel 61 against side supports 25 and 26 at a location spaced above lower edge 65, the lower section of lower panel 61 along lower edge 65 abuttingly engages side supports 25 and 26 to hold the entirety of lower panel 61 against side supports 25 and 26. The Soss hinge 62 (FIG. 5) also causes the upper panel 60 to be bound against side supports 25 and 26 and lower panel 61, since the hinge 62 only permits the panels 60 and 61 to flex in a direction away from side supports 25 and 26. Also, the marginal edges of panels 60 and 61 overlap against the side supports 25 and 26, and are positioned abuttingly adjacently against the worksurface 22 and the bookshelf bottom shelf 40. Further, the panels 60 and 61 are positioned immediately adjacent each other at hinge 65. Thus, the work area of worksurface 22 is completely protected, visually and physically, when the security door 28 is in the extended closed/locked position.

To extend security door 28 from the stored position, the folded security door 28 is telescoped linearly out of the security cavity 29 along path "E1" (FIG. 5). When fully extended, both panels 60 and 61 are pivoted along arc "E2" from the horizontal position to a vertical position. The lower panel 61 is then downwardly ng arc "E3" outwardly and downwardly from the upper panel 60 to a vertical position directly under upper panel 60. The locking finger 72 (FIG. 9) is then pivoted to an interlocked position, such that the locking finger 72 engages the lock plate 67 to retain the security door 28 in a secure position. The work area on worksurface 22 is thus secured. To open security door 28, the above described method is reversed.

The worksurface 22 includes an enlarged horizontal recess in one end, and the work table 30 (FIG. 11) is operably supported therein for limited pivotal movement by a pivot bracket 90 that operably engages a stationary bracket 80 on desk unit 21. The stationary bracket 80 (FIG. 13) includes a rectangular section 82 having a first area 83 without holes, and another area 84 partially surrounding the first area 83 with a plurality of screw holes 85 therein. A triangular shaped section 86 extends from the rectangular section 82. The triangular section 86 includes a hole 88 defining a table pivot axis, and a slot 89 spaced from hole 88. The first area 83 is defined by an arcuate line formed concentrically about the pivot hole 88.

The table bracket 90 horizontally aligned with worksurface 22 is attached to the bottom of work table 30 by screws that extend through screw holes 91 in bracket 90. Second bracket 90 further includes a hole 92 alignable with hole 88, and a second hole 93 generally alignable with slot 89. A sheet bearing material or lubricous material 94 is positioned between brackets 80 and 90. Brackets 80 and 90 and material 94 (FIG. 12) are interconnected by pivot pin 96 (FIG. 12) extended through holes 88 and 92, and a pivot-limiting pin 97 extended through hole 93 and slot 89. When work table 30 is pivoted to the inwardly pivoted position 31 for use by the primary user of the office (see solid lines in FIG. 11), the work table 30 is essentially positioned at 90 degrees from worksurface 22 for maximum ergonomic use by the primary user. An inner end of slot 89 sets the inwardly pivoted position by engagement with pivot-limiting pin 97. When the work table 30 is to be used for conferencing, the work table 30 is pivoted outwardly through a limited arc to the outwardly pivoted position 32. This angle is also preset by design by the engagement of pin 97 at an end of slot 89.

The free end 98 of the worksurface 30A of the work table 30 is supported by a post-supporting stabilizing bracket 99 (FIG. 15). The stabilizing bracket 99 includes a planar section 100, and includes screw holes 101 for securing the bracket 99 to the work table 30. Three stabilizing webs 102 on table leg 103 extend at 120 degree angles to each other from a central hole 104. Screws are extended through central hole 104 into the center post 105 of leg 103, and through holes 105 into leg webs 102.

In the foregoing description, it will be readily appreciated by those skilled in the art that modifications may be made to the invention without departing from the concepts disclosed herein. Such modifications are to be considered as included in the following claims, unless these claims by their language expressly state otherwise.

The embodiments of the invention in which an exclusive property or privilege is claimed are defined as follows:

1. An office furniture construction comprising:

a worksurface having a front edge, the worksurface being located at a height that is easily accessible to a seated person;

a service unit including an overhead bookshelf having top and bottom walls, a rear wall, and a pair of opposite sidewalls, and including at least one service door that is movable between an open position and a closed position for closing the overhead bookshelf, the bottom wall of the bookshelf being spaced above the worksurface, the service unit further including side supports located on opposing side edges of the worksurface that support the bookshelf directly above the worksurface, the service unit still further including a rear sidewall extending between the worksurface and the bottom wall of the bookshelf and extending horizontally between the side supports, the service unit generally enclosing a work area above the work surface and defining a primary work area;

the service unit further including a second shelf spaced below the bookshelf that defines a storage cavity above the second shelf and below the bookshelf; and a lockable bifolding door movably secured by a slidable hinge to the service unit for controlled articulated movement that positions outer show surfaces of the bifolding door against each other in a protected position when in a folded position and that prevents damage during movement between a storage position located within the storage cavity and a security position in which the bifolding door extends between the second shelf and the front edge of the worksurface and also between the side supports to prevent visual and physical access to the primary work area.

2. The office furniture construction defined in claim 1 wherein the bifolding door includes a first panel and a second panel pivoted to the first panel, the first panel being linearly movably supported within the storage cavity by the slidable hinge.

3. The office furniture construction defined in claim 2 including an auxiliary door for covering the storage cavity when the bifolding door is in the storage position.

4. The office furniture construction defined in claim 2 wherein the first panel is located above the second panel when in the security position.

5. The office furniture construction defined in claim 4 wherein the first panel is located below the second panel when in the storage position.

6. The office furniture construction defined in claim 2 wherein the show surfaces of the first and second panels, when in said security position, define a common plane, and wherein the bifolding door includes an intermediate hinge pivotally connecting the first and second panels having a pivot axis positioned generally in said common plane.

7. The office furniture construction defined in claim 2 wherein the first and second panels are pivotable between a folded position wherein the panels lie flat against each other and an unfolded position wherein the panels lie in a common plane.

8. The office furniture construction defined in claim 7 wherein the first and second panels are interconnected by a hinge that limits the rotation of the first panel on the second panel to 180 degrees of rotation.

9. The office furniture construction defined in claim 1 including a lock for securing the bifolding door in the security position, the lock engaging the bifolding door at a location spaced above a bottom edge of the bifolding door when the bifolding door is in the security position.

10. An office furniture construction comprising:

a desk unit defining a worksurface having a primary work area thereabove, the worksurface being located at a height that is easily accessible to a seated person and having a cavity directly below the worksurface such that a seated user's knees and feet may be positioned under the worksurface;

a service unit attached to the desk unit generally enclosing the primary work area except along a front edge of the worksurface;

a work table pivotally attached to the desk unit for horizontal movement along a limited arc between an inwardly pivoted position facilitating use by a primary user and an outwardly pivoted position facilitating use by a group of workers, the work table being located at a height that is easily accessible to a seated person, and being substantially free of obstructions therebelow such that a seated user's knees and feet may be positioned directly below the table; and the service unit including a multi-panel security door movably attached to the service unit for movement between a hidden storage position within the service unit and an extended locked closed position wherein the security door prevents access to the work area;

whereby a primary user can leave confidential papers in the primary work area between work sessions yet can permit use of the work table for conferencing by coworkers and/or subordinates without fear of exposing the confidential papers by moving the security door to the locked closed position.

11. The office furniture construction defined in claim 10 wherein the service unit includes a storage cavity, and wherein the multi-panel security door is operably mounted to the service unit and is configured to collapse to a compact arrangement for storage in the storage cavity.

12. The office furniture construction defined in claim 11 wherein the security door includes a first panel and a second panel pivoted to the first panel for movement between a compact position wherein the first panel lies flat against the second panel and an extended position wherein the first panel lies in a common plane and is collinear with the second panel.

13. The office furniture construction defined in claim 12 including a pivot/translate mechanism for both pivotally and translatably supporting the second panel constructed so that, after the panels are moved to the compact position, the panels can be translated into the storage cavity.

14. In combination, an office furniture construction comprising:

a desk unit defining a worksurface having opposite ends, and front and rear edges, the worksurface being located at a height that is easily accessible to a seated user, said desk unit further defining a cavity directly below the worksurface such that a seated user's knees and feet may be positioned under the worksurface;

a service unit attached to the desk and including a pair of sidewalls along the opposite ends of the worksurface, a rear wall generally located along the rear edge of the worksurface, a first upper wall spaced above the worksurface and extending over the worksurface to define a primary work area between the sidewalls and below the first upper wall, and a second upper wall spaced above the first upper wall for defining a storage cavity; the service unit including a lockable bifolding door movably attached to the service unit for movement between a folded storage position within the storage cavity and an unfolded extended position wherein the bifolding door provides security by preventing access to the primary work area, the bifolding door including a first panel and a second panel pivoted to the first panel by an intermediate hinge, the first panel further including a sliding top hinge operably mounted in the storage cavity for carrying the bifolding door into and out of the storage cavity, the first and second panels being pivotable between the folded storage position where outer visual surfaces of the panels lie flat against each other in a protected arrangement preventing scratches or damage to the outer visual surfaces and the unfolded extended position wherein the outer visual surfaces of the panels lie in a common plane facing outwardly, the intermediate hinge being constructed to permit 180° of rotation of the first panel on the second panel and limiting the initial rotation of the first and second panels to an outward movement away from the worksurface and away from the service unit when initially moving the bifolding door from the unfolded extended position toward the folded storage position; and an elongated work table pivotally connected to the desk unit for horizontal movement along a limited arcuate path, the work table defining a secondary worksurface and being located at a height easily accessible to a seated user, the work table being substantially free of obstructions therebelow such that a plurality of seated users' knees and feet may be positioned directly below the secondary worksurface; whereby a primary user can leave confidential papers in the primary work area between work sessions yet can permit use of the adjacent work table for conferencing by coworkers without fear of exposing the confidential papers by moving the bifolding door to the unfolded extended position.

* * * * *